US006137448A

United States Patent [19]

Schadler

[11] Patent Number: 6,137,448

[45] Date of Patent: Oct. 24, 2000

[54] CENTER FED TRAVELING WAVE ANTENNA CAPABLE OF HIGH BEAM TILT AND NULL FREE STABLE ELEVATION PATTERN

[75] Inventor: John L. Schadler, Raymond, Me.

[73] Assignee: General Signal Corporation, Raymond, Me.

[21] Appl. No.: 09/197,042

[22] Filed: Nov. 20, 1998

[51] Int. Cl.[7] ..... H01Q 13/12

[52] U.S. Cl. ..... 343/770; 343/768

[58] Field of Search ..... 343/770, 771

[56] References Cited

U.S. PATENT DOCUMENTS

| | | | |
|---|---|---|---|
| 2,503,952 | 4/1950 | LaPort | 343/731 |
| 2,507,225 | 5/1950 | Scheldorf | 343/807 |
| 2,580,798 | 1/1952 | Kolster | 343/807 |
| 2,781,513 | 2/1957 | Peterson | 343/816 |
| 2,947,988 | 8/1960 | Masters | 343/771 |
| 3,344,431 | 9/1967 | Greenberg et al. | 343/795 |
| 4,814,783 | 3/1989 | Shelton et al. | 343/795 |
| 5,061,944 | 10/1991 | Powers et al. | 343/795 |
| 5,418,545 | 5/1995 | Pantsios et al. | 343/795 |
| 5,546,096 | 8/1996 | Wada | 343/771 |
| 5,929,821 | 7/1999 | Goldstein et al. | 343/770 |

*Primary Examiner*—Michael C. Wilmer
*Attorney, Agent, or Firm*—Ohlandt, Greeley, Ruggiero & Perle, L.L.P.

[57] ABSTRACT

A digital signal, beam radiation antenna consisting of a cylindrical mast having an inner tubular conductor and an outer tubular conductor, and means for exciting said inner conductor to establish a traveling wave internal to said antenna. Moreover, there are spaced slots in said outer conductor defining an illumination aperture coupled to the inner conductor and for radiating the beam from the antenna. This establishes the illumination along the aperture so as to produce a high beam tilt of the order of 0.6–3.5 degrees from the horizontal for the beam radiation; further, for varying the phase from layer to layer, such that there are substantially no null variations in the elevation pattern of the beam.

8 Claims, 7 Drawing Sheets

MAXIMUM POWER IS 7.2% AT LAYER 16
POWER SPLIT (TOP/BOTTOM); 100/0

THE RESULTANT PHASE TAPER OF A CENTER FED ANTENNA IS ZERO AND THUS THERE IS NO BEAM SWAY.

CENTER FED TRAVELING WAVE ANTENNA CAPABLE OF HIGH BEAM TILT AND NULL FREE STABLE ELEVATION PATTERN

The present invention relates broadly to traveling wave antennas and, more particularly, to an antenna of such type which is particularly suited for high frequency beam radiation where digital signals are involved such as digital TV, data and the like.

BACKGROUND OF THE INVENTION

The television broadcast industry is especially focusing at this time on the development of digital television equipment, and, as part of that program, it seeks to develop new products for TV stations special needs. In this regard, the FCC has issued a large number of new licenses to stations in the United States for digital television (DTV) broadcast, such licenses being in the range from 50 KW to 1,000 KW of effective radiated power (ERP). However, there are within the noted range a group of 680 stations or so which operate at ERP between 50 and 100 KW.

It has been suggested that the particular group of 680 stations or so could radiate power at as much as 1,000 KW as long as they directed that power so that it did not produce a field at their assigned Grade B contour that was greater than the equivalent of their current allotted DTV power. In order for these stations not to produce a field outside their Grade B contour that would be greater than their allotted effective radiated power (ERP), high electrical beam tilts would be necessary. For example, if a station has an antenna which is for 1,500 feet above the average terrain, the Grade B contour will lie at a depression angle of approximately 0.6 degrees below the horizontal. If the allotted ERP at this point is 50 KW, it can be seen by reference to FIG. 7 herein that the power levels inside the assigned Grade B contour, referred to above, can effectively be increased by 7 DB and thus become competitive with more powerful stations in the same area of coverage.

It might be thought that due to the characteristics of a traveling wave type antenna, it would be possible to achieve the desired high electrical beam tilts by simply designing large phase spreads along the illumination aperture of the antenna. But such an approach requires a sophisticated analysis to meet fully the needs of the users whose power outputs are limited.

Accordingly, it is a primary object of the present invention to provide a traveling wave antenna that will establish the required high beam tilt necessary for the given context, but will satisfy the requirements of keeping the fields produced within the required Grade B contour as described.

Another object is to produce an elevation pattern with the required high beam tilt and with substantially no null variations, that is to say to have the null variations, as exemplified by FIG. 1, substantially filled in.

Yet another primary object is to realize insubstantial beam tilt variations which would otherwise occur with frequency in the elevation pattern of the beam. These beam variations or sway that occur are due to the fact that as the frequency varies above and below the design frequency, it becomes necessary to compensate for the so-called "phase taper" from layer to layer of the antenna that is produced. What occurs are beam tilt variations or sway across the channel that is involved.

It has been recognized by the present inventors that the problem of beam sway can be eliminated by center feeding the traveling wave antenna. This will be explained in detail hereinafter. Sufficient to say here that even though there is still a phase taper due to the frequency variation, that is, the variation from the design frequency to both frequencies below and above the design frequency, these phase tapers can be canceled. Thus, in accordance with the present invention by means of center feeding of the traveling wave antenna which involves, in effect, dividing the antennas into two halves, the phase taper in the top half is in the opposite direction from the phase taper in the bottom half. Consequently, the resultant phase taper is zero, eliminating any beam sway or variation with frequency.

In order to furnish some background material with respect to the invention, reference may be made to Masters patent U.S. Pat. No. 2,947,988 in which a disclosure is made of a traveling wave antenna particularly suitable for high frequency transmission. Whatever advantages reside in the provisions of that traveling wave antenna, it does not accomplish the objectives of the present invention, inasmuch as it does not produce the necessary high beam tilt along with the other mandated characteristics for the elevation pattern. For example, it does not realize the aforenoted objective achieving substantially no null variations in the elevation pattern for the beam. This is because the Masters scheme for realizing beam tilt functions by dependency on quarter-wave length spacing.

It should be noted that the term "illumination" in the antenna art is defined as a continuous relationship, shown herein by a typical known graph, which is a plot, as seen in FIG. 2, of relative radiated amplitude and phase between layers of the antenna. Since a traveling wave antenna, by definition, consists of matched layers that exhibit an attenuation producing radiation, and these layers are separated by some fraction of a wave length which creates a constant phase relationship from layer to layer, illumination here is in the form of a continuous straight line (constant slope).

Also, it should be understood that the elevation pattern of FIG. 1, for a UHF end fed traveling wave antenna produces the typical differential gain versus elevation angles across the band that would be expected. Thus, what results is a five DB variation in signals strength across the band at certain elevation angles. This is unacceptable for two reasons; first, it creates a high slope in the signal strength from one end of the band to the other at the receiver or which the automatic gain control must compensate; secondly, and most importantly, it spills energy outside of the Grade B contour which is imposed; that is, by the "coverage fence" according to the FCC rules.

SUMMARY OF THE INVENTION

The solution to the problem or difficulty already described resides in the primary feature of the present invention which recognizes that a unique means must be provided for establishing the illumination along the antenna aperture involving large phase spreads, wherein the illumination, or phase to radiated amplitude relationship, is in the form of connected linear segments having varying slopes; and in the specific embodiment, with mirror images established for the separate halves of a center fed traveling wave antenna By reason of such construction, a high beam tilt as desired can be realized and with substantially no null variations and insubstantial beam tilt variations with frequency in the elevation pattern of the beam.

Accordingly, the broad feature of the present invention is defined as follows: A digital signal, beam radiation antenna comprising: a cylindrical mast having an inner tubular conductor and an outer tubular conductor, and means for exciting the inner conductor to establish a traveling wave internal to said antenna; spaced slots in said outer conductor defining an illumination aperture coupled to the conductor and for radiating the beam from the antenna; means for establishing the illumination along the aperture so as to produce a high beam tilt of the order of 0.6–3.5 degrees from the horizontal for the beam radiation; and means for varying the phase from layer to layer, such that there are substantially no null variations in the elevation pattern of the beam.

An ancillary feature of the present invention resides in the provision of a radiating end load for each of the upper and lower half of the center fed antenna of a preferred embodiment. For the purpose of this invention a "center fed traveling wave antenna" can be defined as two traveling wave antennas; one fed from the center down and the other fed from the center up. The last layer in each half is the end load which radiates any excess energy remaining at the top and bottom layers. Each half exhibits a linear amplitude taper but the phase relationships from layer to layer can be controlled through spacing, that is, through varying the axial dimension of the successive layers, a layer being the distance or dimension between the centers of adjacent slots.

Accordingly, what has been realized is that if the illumination is shaped in such a way as to create smooth null-fill in the elevation pattern, i.e., a fully efficient radiation output will be attained.

It will be understood that a benefit of the present invention is that because each layer of the traveling wave antenna of the present invention is matched and acts independently, a large variety of azimuth patterns can be offered by changing the number of slots and their location around the antenna, and/or by adding eternal directors to the exterior of the antenna.

Other and further objects, advantages and features of the present invention will be understood by reference to the following specification in conjunction with the annexed drawings, wherein like parts have been given like numbers.

BRIEF DESCRIPTION OF DRAWING

FIG. 4 is a diagram depicting the resultant phase taper of a center fed antenna for three different situations to demonstrate lack of beam sway as the frequency varies from the design frequency.

DESCRIPTION OF PREFERRED EMBODIMENT

Figure 1:
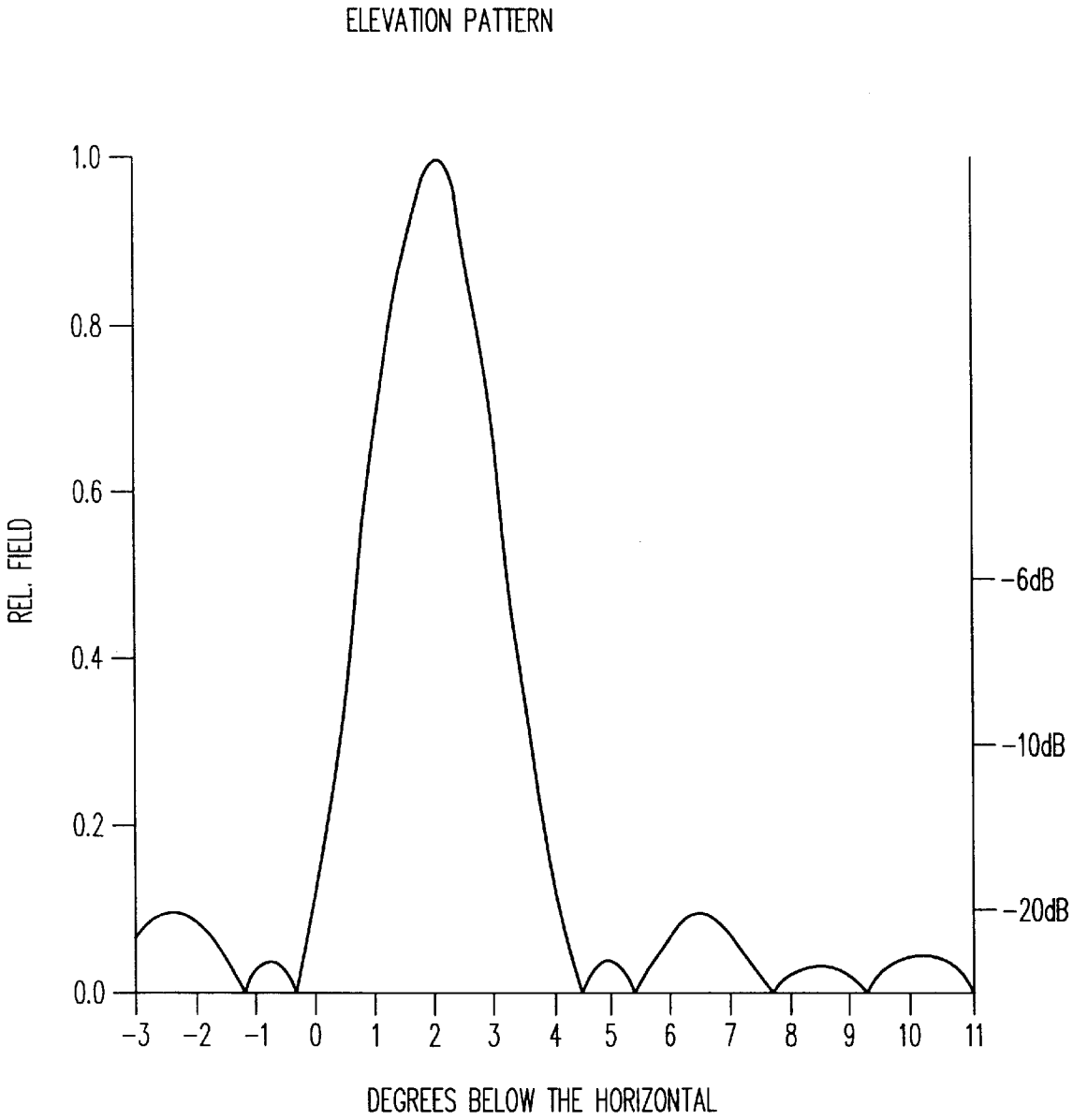
FIG. 1 is an elevation pattern for a known antenna design radiating at a particular frequency, indicating that the power levels inside the Grade B contours can be significantly increased by appropriate beam tilt.
Figure 2:
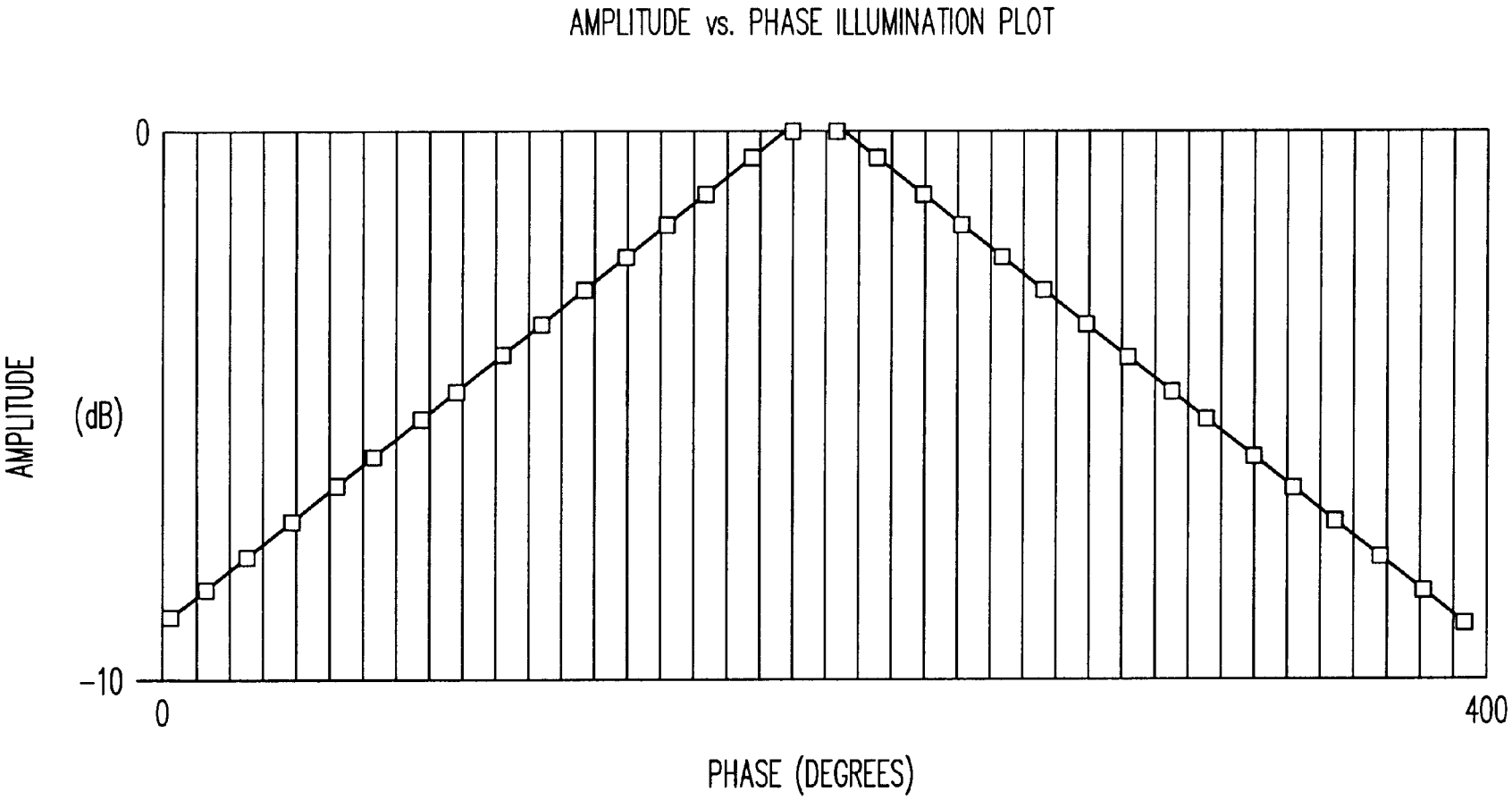
FIG. 2 is an illumination graph (phase vs radiation amplitude) for the known antenna design of FIG. 1.
Figure 3:
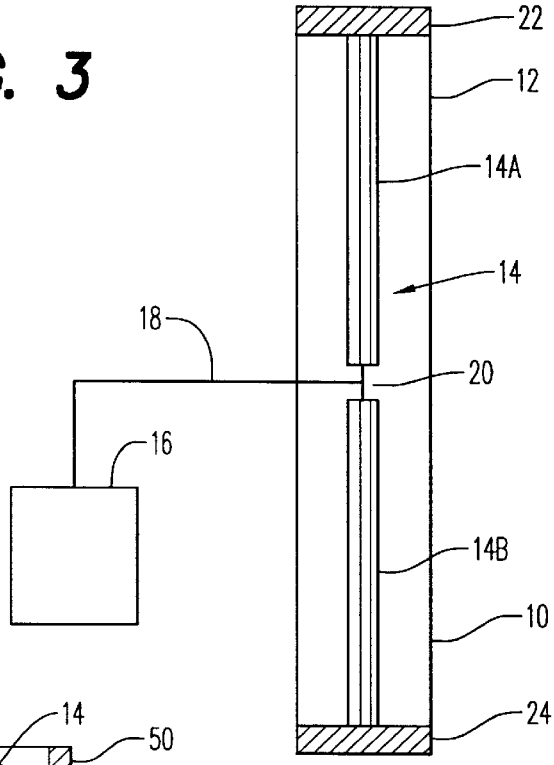
FIG. 3 is a schematic diagram showing a preferred embodiment of the antenna of the present invention.

Referring now to the figures of the drawing and in particular for the moment to FIG. 3, there is shown in schematic form a traveling wave antenna 10. The antenna is in the shape of a mast having an outer tubular conductor 12 and an inner tubular conductor 14, the inner conductor being excited from a source 16. An exemplary group of slots (not seen here) is formed in the wall of the outer tubular conductor 12. The source 16 is connected by a line 18 to a common stub 20; thence, to the upper and lower halves 14*a* and 14*b* of the inner conductor. Thus, it will be appreciated that the upper half is fed from the center up and the lower half from the center down. It will also be seen that the last layer in each half is a radiating end load 22 and 24, respectively, which radiates any excess energy remaining at the top and bottom layers.

Figures 4A, 4B, 4C:
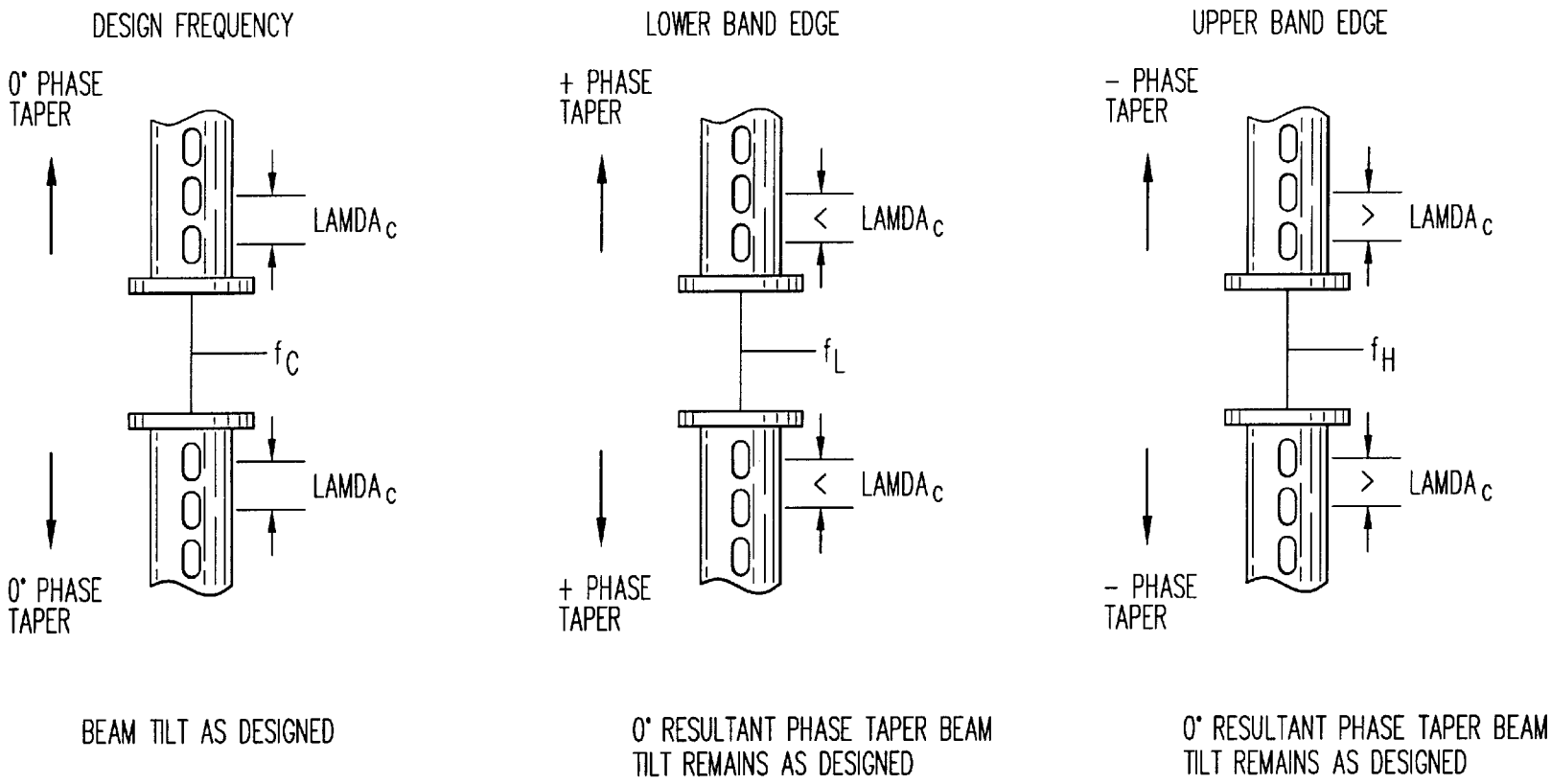
FIG. 4C is a horizontal sectional view taken or the line 5—5 in FIG. 5A.

Referring now to FIGS. 4A, 4B and 4C there are shown schematically in these figures, the result for the phase taper in the two halves of the center fed antenna of FIG. 3. For the design frequency as shown in FIG. 4A, there is a zero degree phase taper along the antenna in either direction, whereas for the lower band edge of FIG. 4B and the upper band edge of FIG. 4C the phase taper is increased (+) or decreased (−), respectively. In either case, however, such increase or decrease occurs in opposite directions for the respective the halves of the antenna such that there is a zero result in the net phase taper; hence, the beam tilt remains as designed for the center frequency.

Figure 5A:
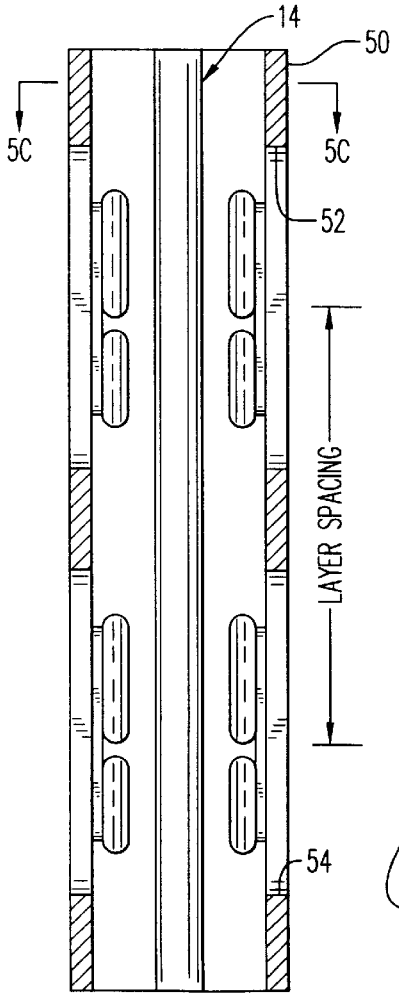
FIG. 5 is a series of fragmentary views of the antenna of FIG. 1, wherein FIG. 5A vertical sectional view.
FIG. 5B is an enlarged view of the coupler showing adjustment of the notch therein.
Figure 5B:
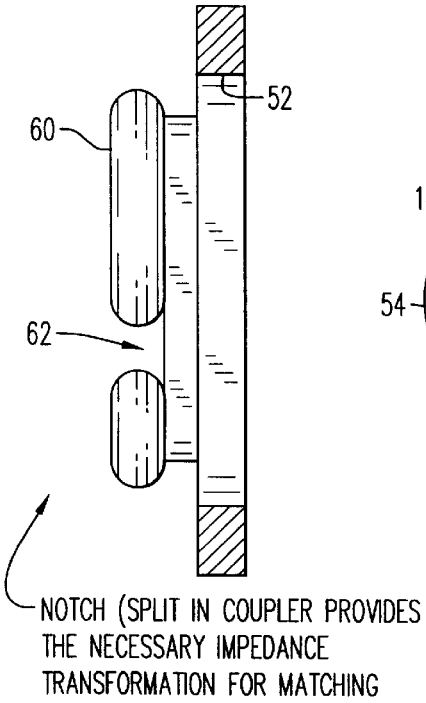
Figure 5C:
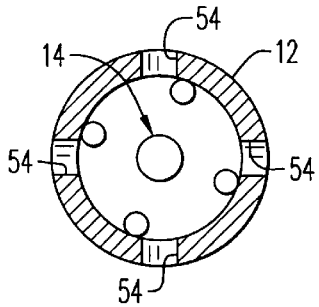

Referring now to FIGS. 5A, 5B and 5C, the first figure shows only a portion of the antenna construction, i.e., in fragmentary form. The outer tubular conductor 50 has a plurality of slot groups, the first group being the upper group of slots designated 52, the second group being the lower group 54. Such groups of slots are present at variable spaced intervals along the entire length of the antenna 10.

It will be understood from FIG. 5A, that in order to achieve a null-free smooth and stable elevation pattern, the phase from layer to layer, as recognized by applicant, must be variable as previously indicated in the summary of the invention. This result is accomplished by varying the layer spacing shown in FIG. 5A, such layer spacing being the axial distance between the centers of adjacent groups of slots, for example, groups 52 and 54. The table below gives the variation in layer spacing (from respective centers of a given slot to adjacent slot) along the antenna, i.e., from slot 1–slot 32 therein. The spacings listed are for an antenna designed to operate at channel 40.

Referring in particular to FIG. 5B there is seen one of the couplers 60 for coupling the radiant energy from inner conductor 14 to the adjacent slot 52. A notch 62 is provided between portions of coupler 60, which notch can be varied in size and position to achieve the necessary impedance transformation for matching the impedance of any individual layer to that of the coupler 60.

Figure 6:
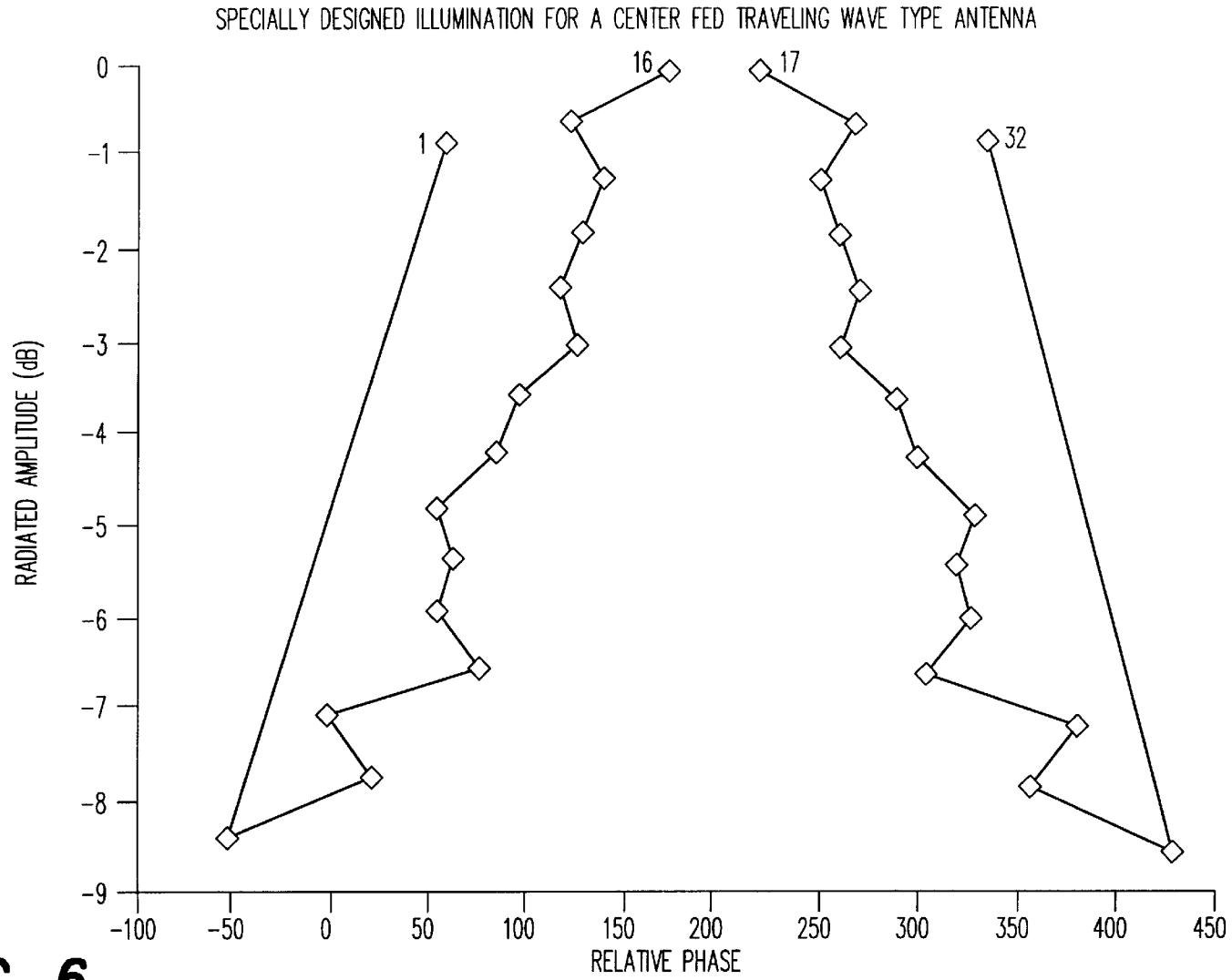
FIG. 6 is a graph depicting the specially designed illumination for a center fed traveling wave type antenna, in accordance with the present invention.
Figure 7:
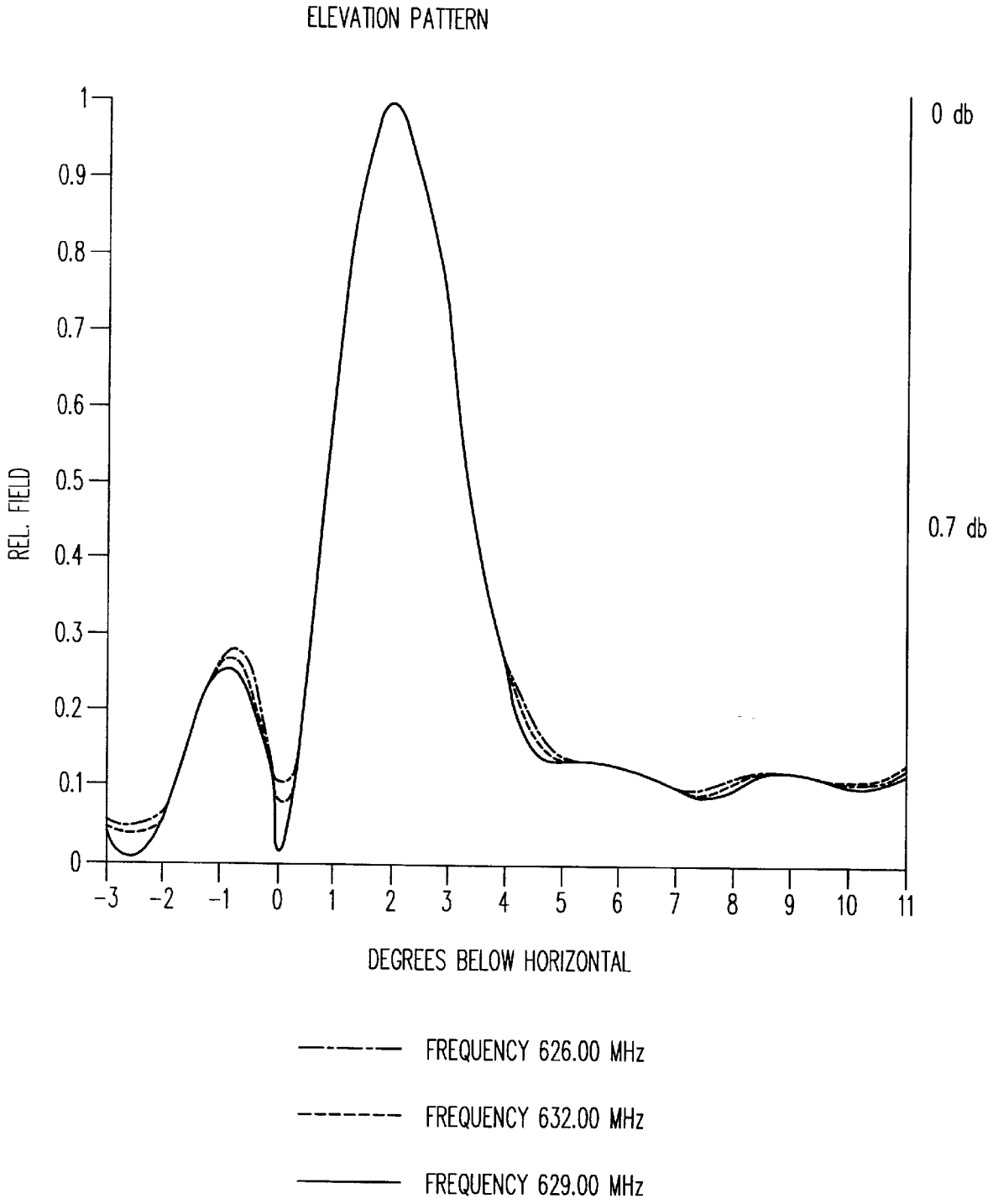
FIG. 7 is the elevation pattern for a special center feed traveling wave antenna, in particular for channel 40 for such antenna, at a design frequency of 629 megahertz and adjacent frequencies of 626 and 632.

It must be pointed out that by utilizing the foregoing design criteria, the illumination depicted in FIG. 6 produces the elevation patterns as shown in FIG. 7. By reason of the fact that the antenna has been center fed the elevation pattern plotted for the specific channel, i.e., channel 40, show the attainment of high beam tilt which is approximately two degrees from the horizontal at peak radiation. This elevation pattern is substantially identical for the frequencies (626 and 632 MHZ) adjacent to the design frequency (629 MHZ) so that the criteria are met for keeping the energy within the Grade B contour specified. This is due to the phase taper cancellation already explained, such that the adjacent frequencies will not cause "spilling" outside that contour.

TABLE

| LAYERS | SPACING |
|---|---|
| 1–2 | 13,474 |
| 2–3 | 22.575 |
| 3–4 | 17.487 |
| 4–5 | 22.762 |
| 5–6 | 17.545 |
| 6–7 | 19.254 |
| 7–8 | 18.301 |
| 8–9 | 20.271 |
| 9–10 | 19.343 |
| 10–11 | 20.242 |
| 11–12 | 18.269 |
| 12–13 | 19.286 |
| 13–14 | 19.286 |
| 14–15 | 17.868 |
| 15–16 | 21.287 |
| 16–17 | 18.765 |
| 17–18 | 16.242 |
| 18–19 | 19.661 |
| 19–20 | 18.243 |
| 20–21 | 18.243 |
| 21–22 | 19.260 |
| 22–23 | 17.284 |
| 23–24 | 18.186 |
| 24–25 | 17.258 |
| 25–26 | 19.228 |
| 26–27 | 18.275 |
| 27–28 | 19.984 |
| 28–29 | 14.767 |
| 29–30 | 20.042 |
| 30–31 | 14.954 |
| 31–32 | 24.055 |

It will be understood that, by virtue of the layer spacing variation chosen, as seen in the Table, the precise illumination of FIG. 6 results, wherein the beam radiation varies with amplitude, as seen, which is a mirror image pattern having two portions for the respective antenna halves, each portion being defined by connected line segments having varying slopes.

Figure 8:
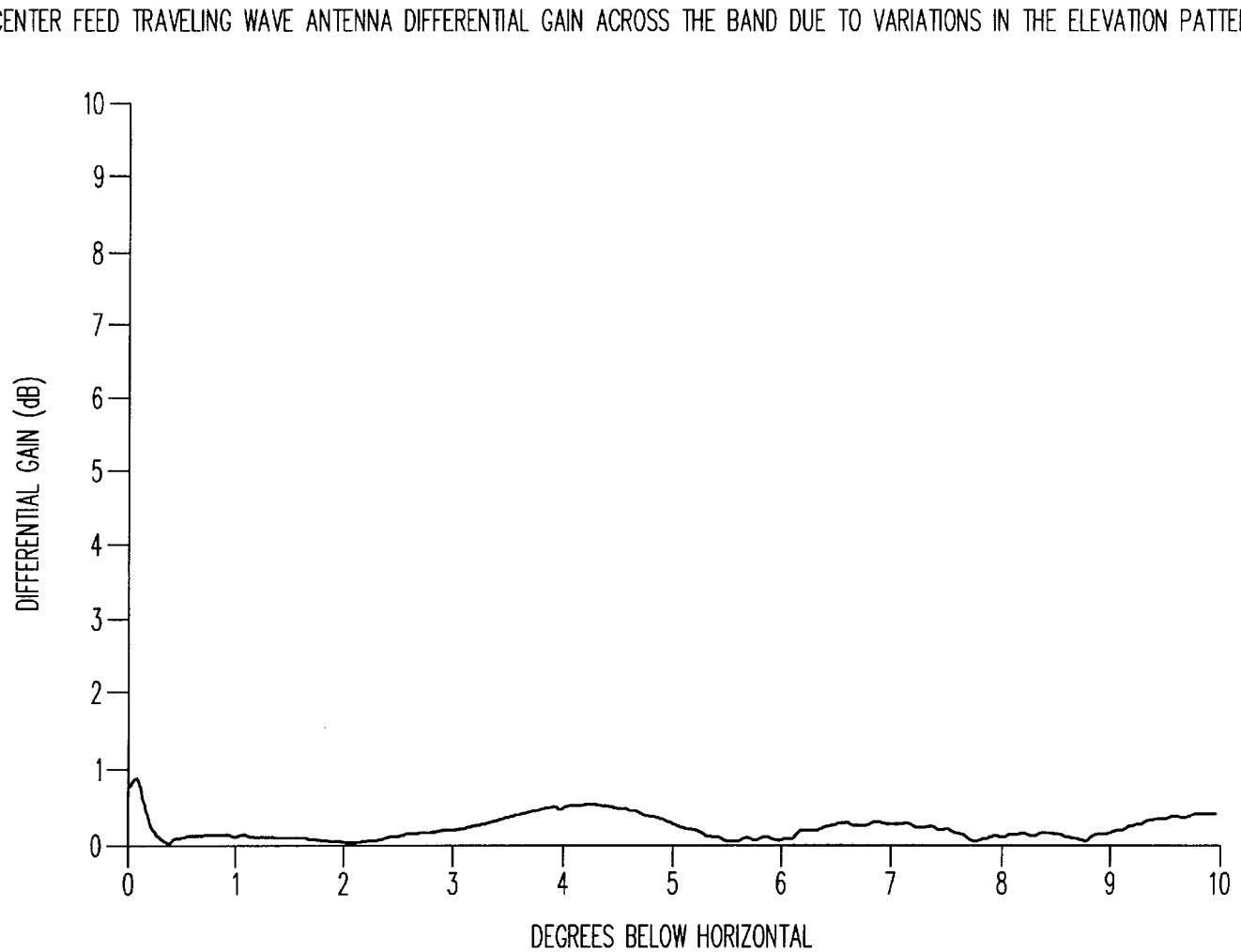
FIG. 8 is a graph depicting differential gain versus degrees below horizontal for a center fed traveling wave antenna.

It will be noted that the corresponding differential gain graph as shown in FIG. 8 proves the far superior performance of this type of antenna over the previously known traveling wave design. Also notably, there are virtually no nulls present in the FIG. 7 elevation pattern with respect to the high values of beam tilt.

The invention having been thus described with particular reference to the preferred forms thereof, it will be obvious that various changes and modifications may be made therein without departing from the spirit and scope of the invention as defined in the appended claims.

What is claimed is:

1. A digital signal, beam radiation antenna comprising:

a cylindrical mast having an inner tubular conductor and an outer tubular conductor that define a plurality of layers, and means for exciting said inner conductor to establish a traveling wave internal to said antenna;

each of said layers including at least one slot disposed in said outer conductor, thereby defining an illumination aperture coupled to the inner conductor and for radiating the beam from the antenna;

means for establishing the illumination along the aperture so as to produce a high beam tilt of the order of 0.6–3.5 degrees from the horizontal for the beam radiation; and wherein the center to center spacings between adjacent ones of the layers vary, such that there are substantially no null variations in the elevation pattern of the beam.

2. An antenna as defined in claim 1, wherein the phase of the beam radiation varies with amplitude in two mirror-image configurations for respective halves of the antenna, each configuration defined by connected line segments having varying slopes.

3. An antenna as defined in claim 1, in which a phase variation from layer to layer of said plurality of layers is produced by the variation in said center to center spacing of adjacent axially spaced slots.

4. An antenna as defined in claim 3, further comprising a coupler system that couples said inner conductor to said at least one slot of each layer, said coupler system having an individual coupler for each layer, and wherein the size and position of each individual coupler is selected to match an impedance thereof to an impedance of the corresponding layer.

5. An antenna as defined in claim 1, in which said means for establishing the aperture illumination includes means for center feeding the antenna, wherein upper and lower halves of the antenna are fed in respectively opposite directions such that insubstantial beam tilt variations with frequency are produced in the elevation pattern of the beam.

6. An antenna as defined in claim 5, further including a radiating end load for each of the antenna halves.

7. An antenna as defined in claim 1, further comprising means for coupling said slots to said traveling wave.

8. An antenna as defined in claim 7, further comprising two portions for the coupling means and a notch between the portions, wherein selection of the size and position of the notch serves to match the impedance of an individual layer of the antenna to the impedance of the coupling means.

* * * * *